US008655199B2

(12) United States Patent
Mizuno

(10) Patent No.: US 8,655,199 B2
(45) Date of Patent: Feb. 18, 2014

(54) IMAGE FORMING APPARATUS WITH DUST DETECTION

(75) Inventor: Manabu Mizuno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 583 days.

(21) Appl. No.: 12/397,998

(22) Filed: Mar. 4, 2009

(65) Prior Publication Data

US 2009/0226192 A1 Sep. 10, 2009

(30) Foreign Application Priority Data

Mar. 4, 2008 (JP) ..... 2008-053290

(51) Int. Cl.
*G03G 15/00* (2006.01)
*G03G 9/00* (2006.01)

(52) U.S. Cl.
USPC ..... 399/14; 399/15; 399/17; 382/112

(58) Field of Classification Search
USPC ..... 399/14, 15, 17; 382/112
See application file for complete search history.

(56) References Cited

U.S. PATENT DOCUMENTS

| | | | | |
|---|---|---|---|---|
| 6,600,579 | B1 * | 7/2003 | Kumagai et al. | 358/474 |
| 7,175,173 | B2 * | 2/2007 | Anzai et al. | 270/58.09 |
| 7,219,973 | B2 * | 5/2007 | Nagatsuka et al. | 347/19 |
| 2006/0126099 | A1 * | 6/2006 | Nakagawa | 358/1.14 |
| 2008/0225355 | A1 * | 9/2008 | Kagami | 358/496 |

FOREIGN PATENT DOCUMENTS

| | | |
|---|---|---|
| JP | 10-56542 | 2/1998 |
| JP | 2002-84392 | 3/2002 |
| JP | 2006-173933 | 6/2006 |

* cited by examiner

*Primary Examiner* — Judy Nguyen
*Assistant Examiner* — Justin Olamit
(74) *Attorney, Agent, or Firm* — Canon USA Inc. IP Division

(57) ABSTRACT

An image forming apparatus includes a reading unit configured to read an original, an image forming unit configured to form an image of the original read by the reading unit on a sheet, a detecting unit configured to detect whether or not the image of the original read by the reading unit includes an irregular part formed by a stray dust particle adhered to the original, and a control unit configured to control, in response to detection of the irregular part by the detecting unit, the image forming unit to make an additional copy of the image of the original including the irregular part.

5 Claims, 5 Drawing Sheets

IMAGE FORMING APPARATUS WITH DUST DETECTION

BACKGROUND OF THE INVENTION

1. Field of the Invention

The present invention relates to image forming apparatuses, and in particular to digital image forming apparatuses such as a copier, a printer, and a facsimile that electrophotographically form images.

2. Description of the Related Art

There are mainly two methods of reading an original with an image reading device included in an apparatus such as a digital copier, scanner, or facsimile: an optical-system-moving method in which an image is read by moving an optical system while the position of the original, which is placed on a glass table, is fixed; and an original-moving method in which an image is read by conveying the original with an original feeder (automatic document feeder: ADF) while the position of an optical system is fixed.

The original-moving method has a problem in that foreign substances, or dust particles, adhered to a platen glass may be imaged as lines extending in a sub-scanning direction, or a direction in which the original is conveyed. To solve this problem, Japanese Patent Laid-Open No. 10-56542 discloses a first exemplary technique in which a reference member having a certain color is provided in such a manner as to face a platen glass, along which an original is conveyed, and the presence of any dust particles is checked in accordance with the result of reading the reference member.

In the first exemplary technique, stationary dust particles adhered to the platen glass can be detected, but stray dust particles following the movement of the original cannot be detected. To solve this, Japanese Patent Laid-Open No. 2006-173933 discloses a second exemplary technique of detecting such stray dust particles.

While the first and second exemplary techniques are each a method of detecting dust particles, Japanese Patent Laid-Open No. 2002-84392 discloses a third exemplary technique in which a report showing the positions of detected dust particles by providing marks thereat is printed.

All of the foregoing exemplary techniques, however, have respective problems described below and have been desired to be further improved.

The first and second exemplary techniques have the following problem. Although lines formed by stationary dust particles and stray dust particles following the movement of the original can be detected, it is not easy for a user to locate the detected dust particles on the original. Particularly in the second exemplary technique, although an independent line extending in the sub-scanning direction and including less than a certain number of pixels is recognized as a line formed by a dust particle, such a line cannot be distinguished from an actual printed pattern.

The third exemplary technique, in which a report showing the positions of dust particles by providing marks thereat is output, has the following problem. If, for example, such a report is output while a large number of images are formed, the report is mixed into the resulting printed matter.

SUMMARY OF THE INVENTION

In light of the above, the present invention provides an image forming apparatus capable of performing image formation without interruption even if any foreign substances are detected during image reading and enabling easy identification of page numbers having such foreign substances and the positions of the foreign substances after image formation.

According to an aspect of the present invention, an image forming apparatus includes a reading unit configured to read an original; an image forming unit configured to form an image of the original read by the reading unit on a sheet; a detecting unit configured to detect whether or not the image of the original read by the reading unit includes an irregular part formed by a foreign substance; and a control unit configured to control, in response to detection of the irregular part by the detecting unit, the image forming unit such that a number of sheets on which the image including the irregular part is formed is larger than a number of sheets on which the image not including the irregular part is formed.

Further features of the present invention will become apparent from the following description of exemplary embodiments with reference to the attached drawings.

DESCRIPTION OF THE EMBODIMENTS

Embodiments of the present invention will now be described with reference to the drawings.

Figure 1:
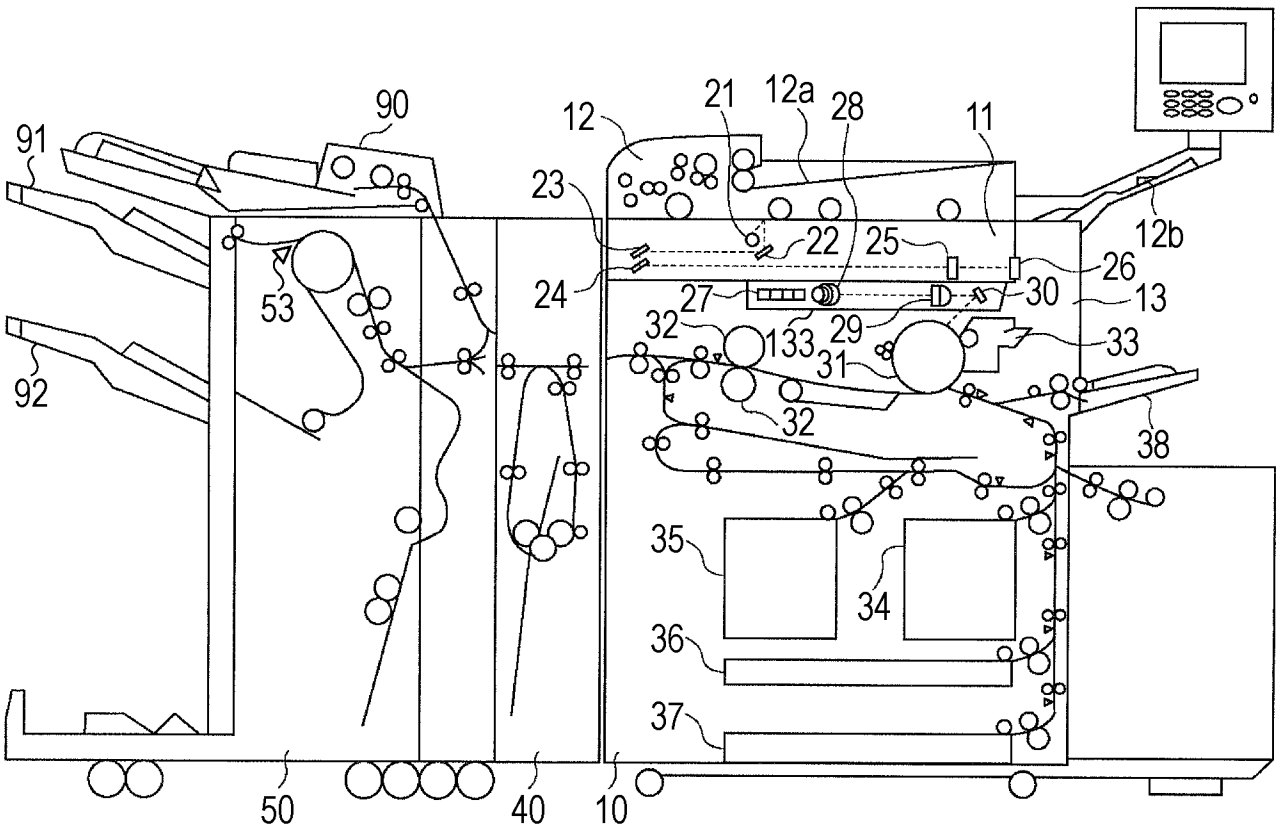
FIG. 1 is a main cross-sectional view of an exemplary image forming apparatus according to an embodiment of the present invention.

FIG. 1 is a diagram showing the configuration of an image forming apparatus according to an embodiment of the present invention. The image forming apparatus includes an image forming device 10, a folding device 40, and a finisher 50. The image forming device 10 includes an image reader 11 and a printer 13. The image reader 11 reads an image of an original.

The image reader 11 is mounted with an original feeder 12, which is typically an automatic document feeder (ADF) that automatically feeds an original. In a stationary-original-reading mode, the original feeder 12 feeds an original that is set face up on an original tray 12*a* one by one from the top page in the leftward direction in FIG. 1, conveys the original along a curved path and a platen glass, and stops the original at a predetermined position. In this state, a scanner unit 21 is scanningly moved from left to right, whereby the original is read. After the reading, the original is discharged to an external discharge tray 12*b*.

A surface of the original that is to be read is irradiated with light emitted from a lamp of the scanner unit 21, and the light reflected by the original is guided by mirrors 22, 23, and 24 to a lens 25. The light passes through the lens 25 and is incident on an image pickup surface of an image sensor 26, whereby an image is formed.

The image sensor 26 reads the image of the original line by line in a main scanning direction, which is a direction perpendicular to an original-conveying direction, while the scanner unit 21 moves in a sub-scanning direction, which is a direction parallel to the original-conveying direction, whereby the entire image of the original is read.

In a moving-original-reading mode, the image sensor 26 reads the image line by line in the main scanning direction, with the scanner unit 21 fixed at a certain position (a reading position), and the original is moved by the original feeder 12 along the platen glass. While the original is conveyed in such a manner, the entire image of the original is read.

The image that has been optically read is converted by the image sensor 26 into image data and is output therefrom. The image data that has been output from the image sensor 26 is subjected to necessary processings performed by an image processor and is then input as a video signal to an exposure control portion 133 (a laser control circuit) of the printer 13.

The exposure control portion 133 of the printer 13 modulates a laser beam emitted from a laser device included in the exposure control portion 133, in accordance with the video signal that has been input thereto. The modulated laser beam is scanningly moved by a polygonal mirror 27 in such a manner as to be guided by lenses 28 and 29 and a mirror 30, and to be applied to a photosensitive drum 31.

In conformity with the scanning movement of the laser beam, an electrostatic latent image is formed on the photosensitive drum 31. The electrostatic latent image on the photosensitive drum 31 is visualized as a toner image by being supplied with toner from a developing unit 33. With a timing synchronous with the start of laser beam application, a piece of paper, or a sheet, is fed from any of cassettes 34, 35, 36, and 37, a manual feeding unit 38, and a duplex conveyance path into a nip between the photosensitive drum 31 and a transfer unit. The toner image formed on the photosensitive drum 31 is transferred by the transfer unit onto the sheet that has been fed thereto.

The sheet carrying the toner image is further conveyed to a fusing unit 32. The fusing unit 32 fixes the toner on the sheet by hot-pressing the sheet. The sheet that has passed through the fusing unit 32 is guided by a flapper and discharge rollers and is discharged from the printer 13 to the outside (to the folding device 40).

To discharge the sheet with the image-carrying surface thereof face down, the sheet that has passed through the fusing unit 32 is guided by the flapper, which is turned accordingly, into a reversing path, where the sheet is temporarily held. Subsequently, after the trailing end of the sheet passes the flapper, the sheet is switched back and is discharged by the discharge rollers from the printer 13.

When a hard sheet such as an overhead-projector (OHP) sheet is fed from the manual feeding unit 38 for image formation thereon, the sheet is directly discharged by the discharge rollers, without being guided into the reversing path, with a surface thereof on which an image has been formed face up.

When a duplex recording option in which images are formed on both sides of a sheet is effective, the sheet is guided by the flapper, which is turned accordingly, into the reversing path and is then conveyed to the duplex conveyance path. Subsequently, the sheet residing in the duplex conveyance path is fed again into the nip between the photosensitive drum 31 and the transfer unit with the aforementioned timing.

The sheet that has been discharged from the printer 13 is conveyed to the folding device 40. The folding device 40 folds a sheet into a Z shape. For example, in a case where a sheet of A3 or B4 size is conveyed and a folding option is effective, the sheet is folded by the folding device 40. In cases other than the foregoing case, the sheet that has been discharged from the printer 13 only passes through the folding device 40 and is conveyed to the finisher 50. The finisher 50 includes an inserter 90 that inserts a specific sheet, such as a cover or an insert sheet, to be added to the sheet having an image formed thereon. The finisher 50 performs binding, stapling, punching, and the like.

The finisher 50 also has discharge trays 91 and 92 onto which sheets having images formed thereon are stacked. The discharge trays 91 and 92 serve as a usual discharge tray (a first tray) and an escape tray (a second tray), respectively, in the embodiment. The destination of sheet discharge is switched by a flapper 53 between the two trays.

Figure 2:
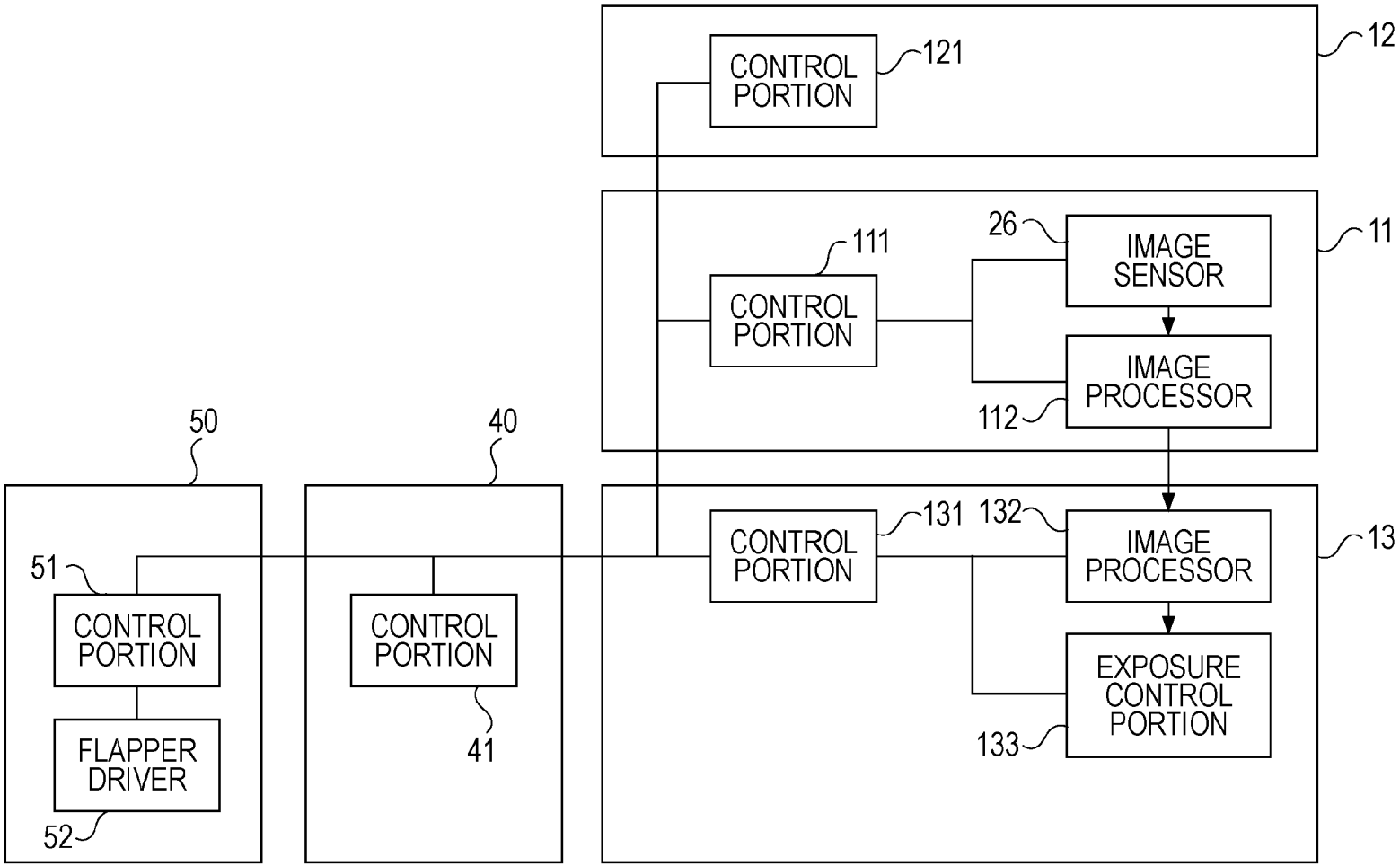
FIG. 2 is an exemplary block diagram of a line-detecting circuit.

FIG. 2 is a control block diagram of the image forming apparatus. Control portions 131, 111, 121, 41, and 51 control the printer 13, the image reader 11, the original feeder 12, the folding device 40, and the finisher 50, respectively. The control portions 131, 111, 121, 41, and 51 communicate with each other via communication lines so as to exchange control information. Image data that is output from the image sensor 26 is input to the exposure control portion 133 via an image processor 112 included in the image reader 11 and an image processor 132 included in the printer 13. The control portion 51 included in the finisher 50 controls a flapper driver 52 that drives the flapper 53, thereby controlling to which of the discharge trays 91 and 92 a sheet having an image formed thereon is to be discharged.

Method of Detecting Stray Dust Particles

Figure 3:
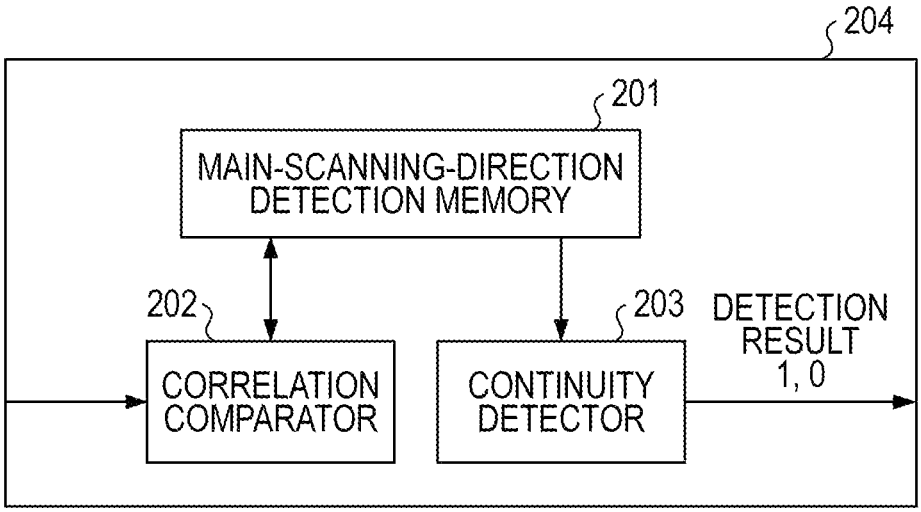
FIG. 3 is a control block diagram of the image forming apparatus.

In the moving-original-reading mode, if an original has any stray dust particles (foreign substances), such a stray dust particle often moves at a speed lower than the speed at which the original is moved, from a position where the scanner unit 21, which is stationary in this mode, resides. In such a case, the stray dust particle stays within a range to be scanned by the scanner unit 21 for a while. Consequently, the stray dust particle is imaged as a line with a certain length extending in the sub-scanning direction. FIG. 3 is a block diagram of a line-detecting circuit 204 that detects an unnecessary line (an irregular part of an image) formed by a stray dust particle (a foreign substance) included in an image that has been read. The line-detecting circuit 204 is included in the image processor 112 of the image reader 11.

A correlation comparator 202 detects whether or not there is a series of target pixels brighter than peripheral pixels by a level exceeding a predetermined level and continuing for more than a predetermined number in the sub-scanning direction. The correlation comparator 202 also detects whether or not there is a series of target pixels darker than peripheral pixels by a level exceeding a predetermined level and continuing for more than a predetermined number in the sub-scanning direction. If the correlation comparator 202 detects such a series of target pixels continuing for more than the predetermined number, the series of target pixels are regarded as a candidate for an unnecessary line formed by a stray dust particle (a foreign substance) or the like. If there are any adjoining pixels correlating with the unnecessary-line candidate in any direction other than the vertical direction (the sub-scanning direction, or the original-conveying direction), the correlation comparator 202 determines that the unnecessary-line candidate is part of an original image, not a line formed by a stray dust particle.

In contrast, if there are no adjoining pixels correlating with the unnecessary-line candidate in any direction other than the vertical direction, i.e., in the horizontal or oblique direction, the correlation comparator 202 determines that the candidate is an unnecessary line formed by a stray dust particle. The line formed by a stray dust particle has less variations in density and width and is characteristic in that the pixels included in the line is continuous only in the vertical direction. Such characteristics are taken into consideration when the correlation comparator 202 makes the determination described above. Thus, parts actually included in an image of the original and unnecessary vertical lines formed by stray dust particles can be distinguished from each other.

More specifically, the correlation comparator 202 checks whether or not the difference between the brightness level of target pixels and the brightness level of pixels horizontally adjoining the target pixels exceeds a predetermined threshold, thereby detecting the image correlation between the target pixels and the pixels horizontally adjoining thereto. If it is determined that there is a correlation between the target pixels and the pixels horizontally adjoining thereto, the correlation comparator 202 determines that the target pixels are not irregular pixels.

In a case where the difference between the brightness level of target pixels and the brightness level of pixels horizontally adjoining thereto exceeds a predetermined threshold, the target pixels brighter than the pixels adjoining thereto form a white line, and the target pixels darker than the pixels adjoining thereto form a black line.

Subsequently, the correlation comparator 202 detects whether or not the target pixels include pixels vertically correlating with each other and continuing for more than a predetermined number in the vertical direction (the original-conveying direction, or the sub-scanning direction). The predetermined number of continuous pixels is determined on the basis of the time in which a stray dust particle typically stays within the range to be scanned by the scanner unit 21. If the target pixels include pixels correlating with each other and continuing for more than the predetermined number (if there is a line extending in the original-conveying direction and longer than a predetermined length), the target pixels form an actual vertical line in the original image. Therefore, the correlation comparator 202 determines that the target pixels form an actual part of the original image. In contrast, if the target pixels include pixels correlating with each other but continuing for less than the predetermined number (if there is a line extending in the original-conveying direction but shorter than the predetermined length), the correlation comparator 202 determines that the target pixels form an irregular line formed by a stray dust particle or the like. In a case of a line that appears when a stationary dust particle adhered to the platen glass is scanned, the position of the stationary dust particle on the platen glass is detected before reading the original, and pixels at the detected position are corrected with reference to pixels on the periphery thereof. The line-detecting circuit 204 in the embodiment detects, in the manner described above, irregular pixels included in image data obtained after the correction of lines formed by dust particles on the platen glass. Thus, lines of both types formed by long-staying stationary dust particles and short-staying stray dust particles can be processed in respectively suitable manners.

If the line-detecting circuit 204 has determined that the detected pixels are irregular, the line-detecting circuit 204 sends data on the positions of those pixels that have been detected to form an unnecessary line and data on the page number in the original having the unnecessary line to the control portion 131 of the printer 13, or stores the foregoing data in a memory (not shown). This is because such information is necessary in outputting a report (a sheet to be discharged to the escape tray 92), which will be described separately below, if a marking option is set to on.

The line-detecting circuit 204 includes a main-scanning-direction detection memory 201. The main-scanning-direction detection memory 201 stores the result of comparison performed by the correlation comparator 202. The main-scanning-direction detection memory 201 has a number of storage areas corresponding to the number of pixels of a charge-coupled device (CCD) aligned in the main scanning direction. A continuity detector 203 detects the continuity of pixel data by checking whether or not a value stored in the main-scanning-direction detection memory 201 exceeds a predetermined value. When the continuity detector 203 detects the continuity of pixel data, the continuity detector 203 sends the result of detection of such a line to a line-correcting circuit included in the image processor 132. The result of line detection can be represented by, for example, a binary flag signal constituted by "1" and "0".

Figure 4:
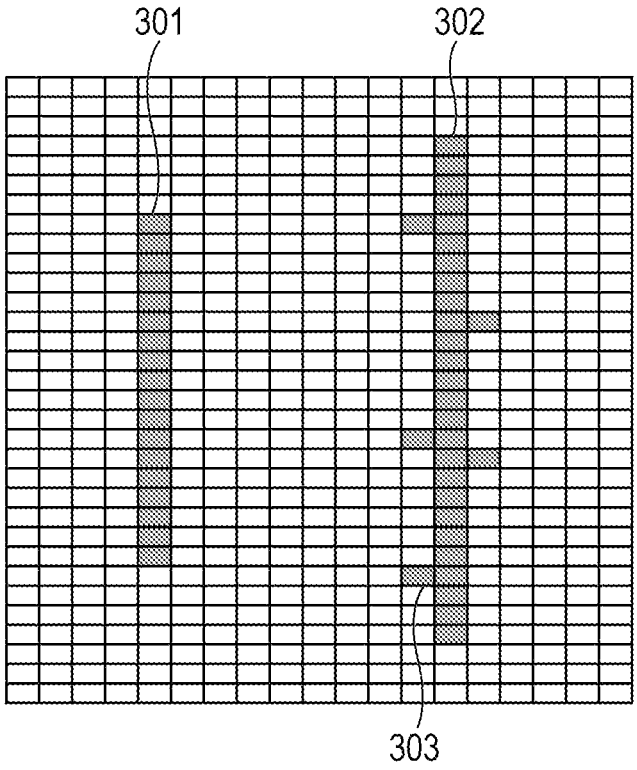
FIG. 4 shows an exemplary difference between a line formed by a stray dust particle and a vertical line included in an original image.

FIG. 4 shows an exemplary difference between an unnecessary line formed by a stray dust particle and a vertical line actually included in an image of the original. In FIG. 4, a vertical line 301 represents an unnecessary line formed by a stray dust particle, and a vertical line 302 represents a part of an actual image in the original. Since the vertical line 302 has horizontally adjoining pixels 303 correlating therewith, the vertical line 302 is determined to be a part of an image in the original, not a stray dust particle. In contrast, the vertical line 301 has no adjoining pixels correlating therewith except the vertically continuing pixels, and the number of pixels continuing in the vertical direction of the original is smaller than the predetermined number. Therefore, the vertical line 301 is determined to be an unnecessary line formed by a stray dust particle.

Figure 5:
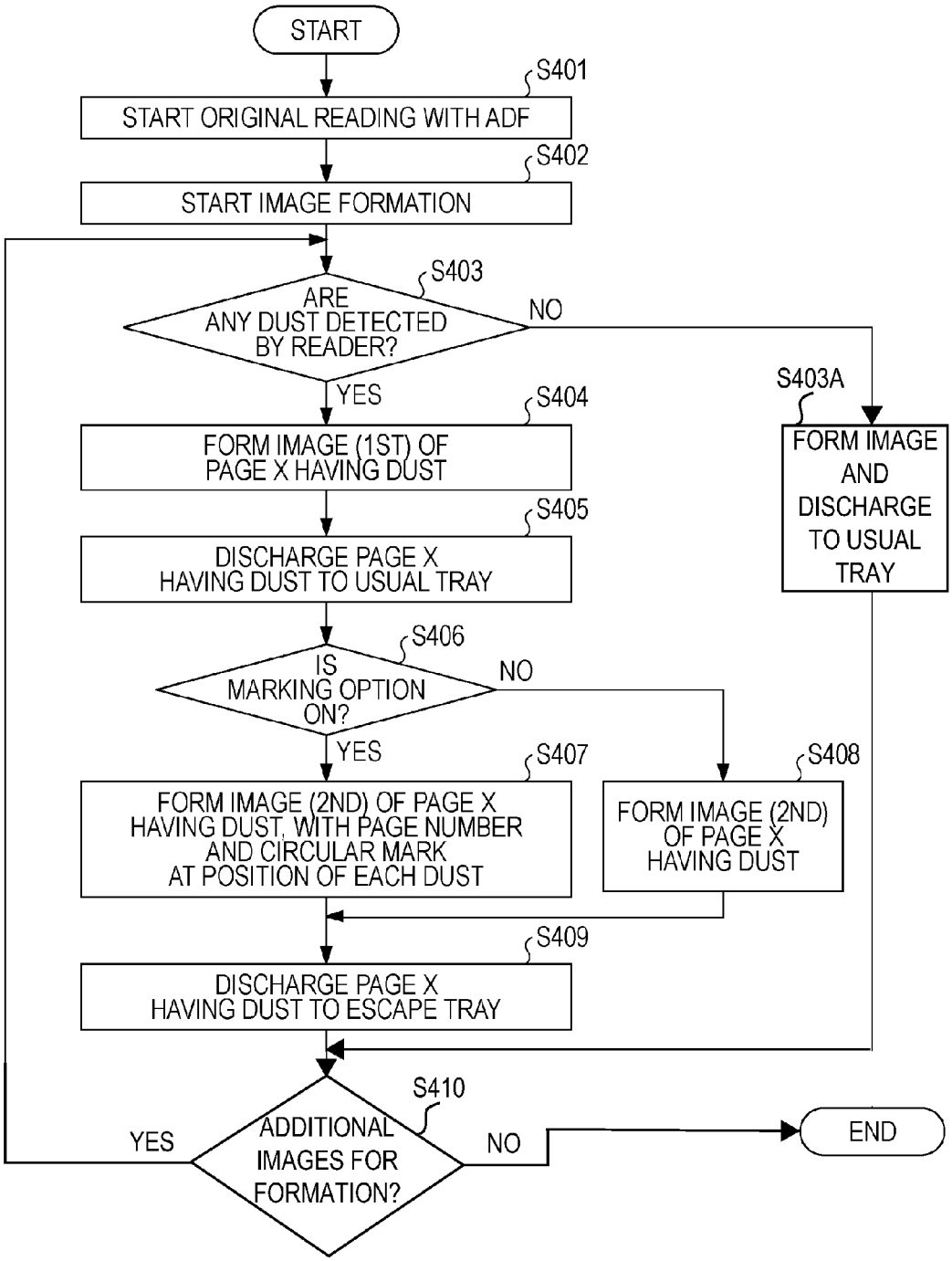
FIG. 5 is an exemplary flowchart showing an operation performed when dust particles are detected by a method of detecting stray dust particles during image formation.

FIG. 5 is a flowchart showing an operation when a stray dust particle is detected during image formation. This operation is performed by the control portion 131 of the printer 13. In step S401, the control portion 131 gives the image reader 11 an instruction to start reading an original with the original feeder 12. In step S402, an image that has been read by the image reader 11 starts to be formed on a sheet. In step S403, if stray dust particles are not detected by the line-detecting circuit 204 of the image reader 11 (NO in step S403), the image is formed as usual and discharged to the usual discharge tray 91 (step S403A). In step S403, if any stray dust particles are detected by the image reader 11 (YES in step S403), the operation proceeds to step S404, in which the image of a page X that has been detected to have dust particles is formed on a sheet as usual (without correcting the pixels corresponding to the dust particles). The image formation performed in step S404 is a first image formation for the page X. Subsequently, in step S405, the sheet having the image of the page X is discharged to the usual discharge tray 91, which is used usually. Then, another image formation for the page X is performed, and another sheet having the image of the page X is discharged to the escape tray 92. The operation branches in step S406, depending on whether or not the marking option is set to on by the user. The setting of the marking option and an example of the mark to be provided will be described separately below. In step S406, if the marking option is set to on (YES in step S406), the operation proceeds to step S407. In step S407, certain processings are performed on the basis of data on the positions of stray dust particles and data on the page number sent from the line-detecting circuit 204. Specifically, the image processor 132 is caused to perform an image processing in which a mark (a circular mark, for example) is added to the image of the page X at each of the positions of the detected stray dust particles, and an image processing in which the page number is added to the image of the page X. The image of the page X having such marks and a page number is formed on a sheet. If, in step S406, the marking option is set to off (NO in step S406), the operation proceeds to step S408, in which the same image as the one (without the marks) on the sheet for the page X that has been discharged in step S405 is formed. Then, in step S409, the flapper driver 52 is controlled by the control portion 51 in such a manner that the sheet for the page X having the image (the second one) formed in step S407 or step S408 is discharged to the escape tray 92. Thus, the sheets having the respective images of the original including the detected irregular pixels are discharged to the usual discharge tray 91 and the escape tray 92, respectively. In step S410, if there are additional images of the original for formation (i.e. "YES" in S410), the process returns to S403 and continues until all of the images of the original have been processed. If there are no additional images of the original for formation (i.e. "NO" in S410), the operation ends.

The above-described operation produces the following advantageous effects. In a case where a large number of pages are copied, detection of stray dust particles can be performed without stopping the copying operation. Further, pages having stray dust particles and positions of the detected stray dust particles can be easily announced to the user after the copying operation. In addition, after the copying operation, the user can see the positions of the detected stray dust particles and can easily check whether the detected lines are of stray dust particles or of actual patterns. If the lines are of actual patterns, the printed matter discharged on the usual discharge tray 91 can be used as it is. If the lines are of stray dust particles, the relevant pages only need to be output again after selecting the setting of the marking option and correcting the lines.

Figure 6:
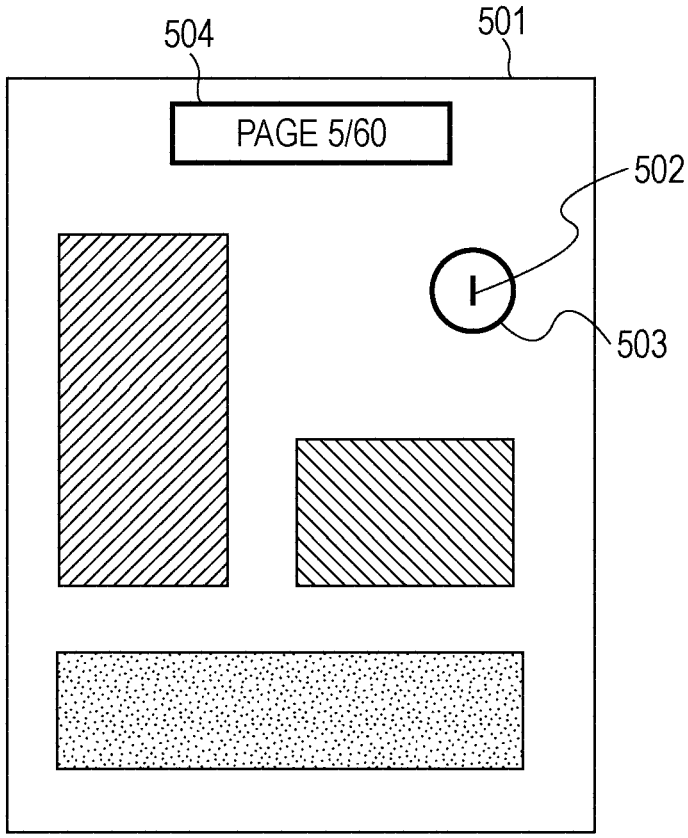
FIG. 6 is a conceptual diagram of a sheet (a report) for a page to be discharged to an escape tray.

FIG. 6 shows an image of a sheet (report) for a page that is discharged to the escape tray 92. A sheet 501 for the page that has been discharged to the escape tray 92 has a mark 503 indicating the position of a detected stray dust particle 502, and a page number 504 for which the stray dust particle 502 has been detected. If any stray dust particles are detected, the user can select the setting of the marking option: whether to output, to the escape tray 92, a report having marks such as those shown in FIG. 6, or a report having no marks. If the marking option is set to on, a report on the page detected to have the stray dust particle is output with the page number 504 and the mark 503 provided at the position of the detected stray dust particle 502, as shown in FIG. 6. If the marking option is set to off, a sheet having the same image as the one formed on the sheet discharged on the usual discharge tray 91 is output.

In the embodiment described above, the image of a page that has been detected to have a stray dust particle is formed on two sheets. The number of sheets on which such an image is to be formed is not limited to two, and such an image may be formed on more than two sheets. Specifically, in response to the detection of any irregular pixels, the image of each of the pages that has been detected to have irregular pixels may be formed on a number of sheets more than the number of sheets on which the image of each of the other pages that has been detected to have no irregular pixels is formed. For example, sheets may be discharged selectively in such a manner that a sheet having an image formed as usual (uncorrected) is discharged to the usual discharge tray 91, while a sheet as a report having marks and a sheet having an image in which pixels corresponding to stray dust particles are corrected are discharged to the escape tray 92.

To summarize, according to the embodiment described above, image formation can be performed without interruption even if any foreign substances are detected during image reading, and pages having the foreign substances and the positions of the detected foreign substances can be found easily after the image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-053290 filed Mar. 4, 2008, which is hereby incorporated by reference herein in its entirety.

What is claimed is:

1. An image forming apparatus comprising:

a reading unit configured to read an original document;

an image forming unit configured to print a copy of the original document read by the reading unit;

a discharge unit configured to discharge a sheet printed by the image forming unit to a first tray or a second tray;

a determining unit configured to determine whether or not a page of the original document read by the reading unit includes an irregular part formed by a foreign substance; and a control unit configured, in a first case when the determining unit determines that the original document does not include any page with an irregular part, to control the image forming unit to print a copy of the original document and to control the discharge unit to discharge the copy to the first tray, and in a second case when the determining unit determines that a page of the original document includes the irregular part, to control the image forming unit to automatically print a copy of the original document and to print an additional copy of the page of the original document with the irregular part and to control the discharge unit to discharge the copy of the original document to the first tray and the additional copy of the page of the original document with the irregular part to the second tray.

2. The image forming apparatus according to claim 1, wherein, in response to detection of the irregular part by the determining unit, the control unit controls the image forming unit to form a mark on the irregular part in the additional copy, and controls the discharge unit to discharge the additional copy on which the mark is formed to the second tray.

3. The image forming apparatus according to claim 1, wherein the determining unit detects a stray dust particle adhered to the original.

4. The image forming apparatus according to claim 1, further comprising:

an original-conveying unit configured to convey the original to a reading position, wherein the reading unit reads the image of the original while the original is conveyed through the reading position by the original-conveying unit.

5. The image forming apparatus according to claim 4, wherein the determining unit detects, as the irregular part, a line extending in a direction in which the original-conveying unit conveys the original and having a length smaller than a predetermined length.

* * * * *